United States Patent [19]

Johansson et al.

[11] Patent Number: 4,554,860

[45] Date of Patent: Nov. 26, 1985

[54] PRESSURE DAMPER FOR RECOILLESS WEAPONS

[75] Inventors: Börje Johansson; Torbjörn Pramskog, both of Eskilstuna; Jan-Erik Sandberg, Torshälla, all of Sweden

[73] Assignee: Forenade Fabriksverken, Eskilstuna, Sweden

[21] Appl. No.: 435,504

[22] Filed: Oct. 20, 1982

[30] Foreign Application Priority Data

Oct. 21, 1981 [SE] Sweden ..... 8106212

[51] Int. Cl.[4] ..... F41F 17/14; F41F 17/12; F41F 3/02

[52] U.S. Cl. ..... 89/1.7; 89/14.1; 89/14.2

[58] Field of Search ..... 89/1 E, 14.1, 14 B, 89/1.7, 1.701–1.706

[56] References Cited

U.S. PATENT DOCUMENTS

| | | | |
|---|---|---|---|
| 445,399 | 1/1891 | Gathmann | 89/14.1 |
| 799,884 | 9/1905 | Von Augezd | 89/14.1 |
| 2,010,178 | 8/1935 | De Bruin | 89/1 E |
| 2,128,936 | 9/1938 | Green | 89/14 B |
| 2,774,281 | 12/1956 | Hawkins | 89/1 E |
| 2,935,912 | 5/1960 | Hartley | 89/14.1 |
| 4,454,798 | 6/1984 | Shea et al. | 89/14 B |

OTHER PUBLICATIONS

Minnery, John A., *Firearm Silencers,* vol. 2, Cornville, Ariz., 8/1981, p. 177.

*Primary Examiner*—Stephen C. Bentley
*Assistant Examiner*—John S. Maples
*Attorney, Agent, or Firm*—Fleit, Jacobson, Cohn & Price

[57] ABSTRACT

Pressure damper for recoilless weapon designed to reduce the pressure in the area around and immediately to the rear of the muzzle of the barrel. A container with liquid is placed in the barrel close to its muzzle or in a forward extended portion of the barrel and arranged to be burst when the weapon is fired so that the liquid is suddenly released and mixed with the gases from the powder.

2 Claims, 5 Drawing Figures

PRESSURE DAMPER FOR RECOILLESS WEAPONS

The present invention relates to a pressure damper for recoilless weapons, particularly one-shot weapons, designed to reduce the pressure in the area around and immediately to the rear of the barrel muzzle.

To obtain freedom from recoil in weapons it has been customary to provide an extra powder charge at the rear of the projectile and to allow the gases from the powder produced to rush out to the rear through a discharge nozzle. This results in a rearward-directed movement quantum (weight times velocity), which can be adapted so that it is equal in magnitude to that of the advancing projectile. Hence when the projectile leaves the barrel, the gases from the powder rush partially rearwards through the discharge nozzle, and partially forward through the barrel muzzle. The firer, who with this type of "backblast weapon" has his head relatively close to the barrel muzzle (see FIG. 1 which illustrates schematically a conventional firing position when firing a backblast weapon), is then subjected to a pressure which originates from both the forward and the rearwards moving powder gases. Obviously it is a requirement that this pressure be kept as low as possible so that it does not become too much of a burden on the firer. On the other hand it is desirable to increase the weight and performance of the projectile, with the result that the weapon pressure and hence also the pressure outside the weapon increase.

For this reason various methods have been proposed for reducing the pressure outside the weapon without the weapon pressure having to be reduced as a result. Inter alia it has been proposed that a counter mass be employed. This is located at the rear of the projectile in a backblast weapon and is designed to be ejected backward from the weapon essentially simultaneously with the forward ejection of the projectile. Usually the counter mass is so designed that it is vaporised or pulverised to form a harmless dust at the rear of the weapon. It has been shown that by this means it has been possible to reduce the pressure at the rear and to a certain extend also around the weapon muzzle.

The object of the present invention is to provide a pressure damper which can be used for recoilless weapons which reduces the effect of the gases from the powder which emerge from the weapon muzzle on the area around and immediately to the rear of the muzzle. This objective is achieved in accordance with the invention in that at least one container filled with liquid is so located in the barrel close to its muzzle or in a forward extension of the barrel that when the weapon is fired this bursts and by this means suddenly releases the said liquid, as a result of which the liquid is mixed with the powder gases.

Since the liquid is released from the container by bursting of the latter, the entire quantity of liquid in the container is intermixed with explosive rapidity with the power gases. A very violent reaction then takes place between the liquid and the powder gases, with the result that the powder gases are to a high degree quenched. This results in a considerable reduction in the pressure in the area around and immediately to the rear of the weapon muzzle. Apart from this effective pressure reduction, simultaneously a considerable degree of extinction of the muzzle flame is achieved. This is naturally of great strategic importance because it reduces the chances of the enemy spotting the location of the weapon.

The invention will be discussed in greater detail by reference to the appended drawings.

Figure 1:
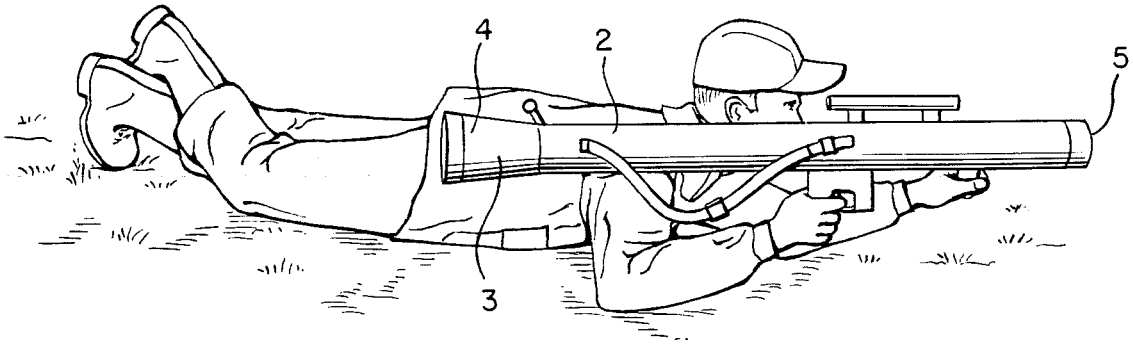
FIG. 1 shows schematically a conventional firing position when firing a conventional backblast weapon.

FIG. 1 illustrates a customary firing position when firing a conventional backblast weapon 1. The weapon consists, in a known manner, of a barrel 2 with breech 3 which has a venturi 4. As indicated by the diagram, the head of the firer is relatively close to the muzzle 5 of the barrel, so that the pressure around the firer is to a considerable extent governed by the pressure of the powder gases rushing out the barrel muzzle.

Figure 2:
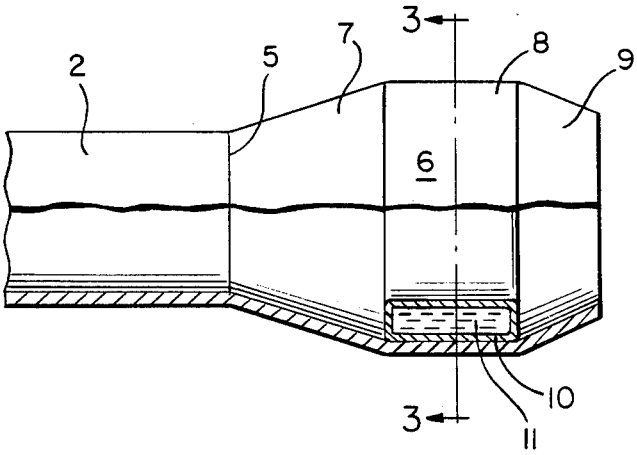
FIG. 2 illustrates a longitudinal section, partially in side view, of the forward portion of a recoilless weapon barrel provided with a preferred embodiment of the pressure damper in accordance with the invention.
Figure 3:
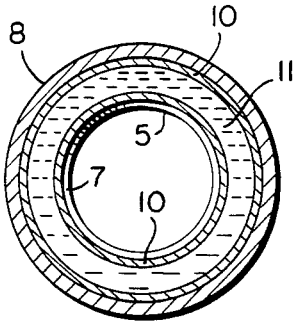
FIG. 3 shows the section along the line III—III in FIG. 2.

FIG. 2 illustrates the forward section of a barrel 2 in a recoilless weapon which is not shown. The actual muzzle 5 of the barrel changes at the front into an over-shized extension 6 which consists of a section 7 which forward from the muzzle 5 opens up in conical fashion, and which is tubular shaped to the rear, an intervening over-sized tubular section 8 of constant diameter, and a forward tubular section 9 which tapers off. A toroid-like container 10 which is arranged concentrically around the projectile axis rests against the inner wall of the intermediate section 8 and its toroidal shape is flattened so that the toroid is given a mainly rectangular cross section, the long side of which has the same length as the intermediate section 8, so that the container 10 is kept clamped in position between the conical walls in sections 7 and 9.

The container 10, the walls of which are made of celluloid or similar material which can be burst apart by the gases from the powder, is filled with a liquid 11 in the form of for example a salt solution, preferably containing calcium chloride.

The circular aperture of container 10, which is placed concentrically around the projectile axis and the muzzle of the forward tube portion 9, has a diameter which is somewhat greater than that of the barrel. As a result a projectile can pass freely through the extension portion 6.

When the rear section of a projectile leaves the muzzle 5 in FIG. 2, the powder gases located to the rear of the projectile rush forward into the tubular section 7, and then to the container 10 which as a result is disintegrated by the powder gases. The liquid 11 in the container is thus explosively released and mixes with the powder gases which as a result are quenched.

Figure 4:
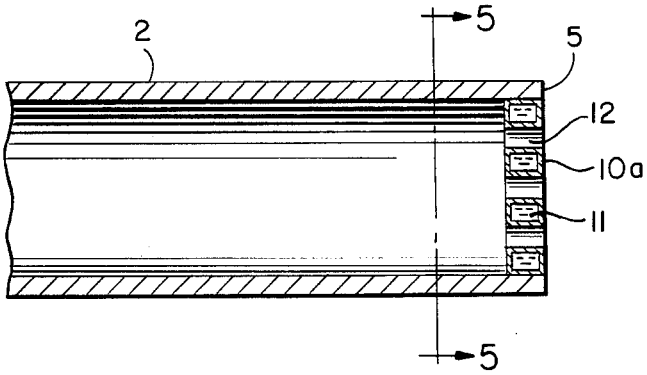
FIG. 4 illustrates a longitudinal section of a modified embodiment of the pressure damper in accordance with the invention.
Figure 5:
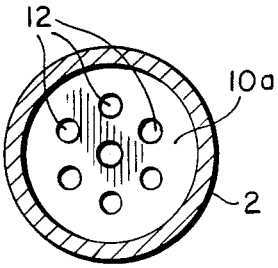
FIG. 5 shows a section along the line V—V in FIG. 4.

Instead of allowing the powder gases to disintegrate the container 10, the latter can be located centrally in the path of the projectile so that it is disintegrated as a result of being pierced by the projectile. Such an embodiment is illustrated in FIGS. 4–5. In this embodiment no extension portion is required, as with the embodiment shown in FIG. 2, and the liquid-filled container designed as 10*a* in FIGS. 4–5 is merely introduced and fastened in an appropriate manner in the muzzle 5 of the barrel of a conventional weapon. The attachment of the container 10*a* can take place in many different ways. For example it can be bonded to the wall of the barrel 2, or provided with a chamfer (not shown) so that it can be snapped firmly into the barrel.

The container 10*a* which is made of celluloid or similar material and filled with a liquid 11 of the same type as in the embodiment shown in FIG. 1 has six through apertures 12 which are parallel with the projectile axis. The object of these apertures is, when the weapon is fired, to permit the powder gases which can leak past the projectile before the powder gases reach the container 10*a* to be discharged to the surrounding atmosphere. By this means the apertures 12 prevent premature bursting of the container 10*a*.

The invention is not restricted to the embodiment shown and described, a large number of modifications thereof being feasible within the framework of the following claims.

We claim:

1. The combination of a pressure damper and a recoilless weapon having a barrel and a muzzle, the pressure damper designed to reduce the pressure in the area around and immediately to the rear of the muzzle of the barrel and comprising at least one container filled with a liquid which is so located in the muzzle region of the barrel that, when the recoilless weapon is fired, the at least one container bursts and as a result explosively releases the said liquid, so that said liquid is mixed with powder gases to reduce the pressure of the powder gases, said at least one container is cylindrically shaped and defines a plurality of apertures aligned parallel to a longitudinal axis of the barrel when said at least one container is located in the barrel, said plurality of apertures permitting gases to leak from the muzzle ahead of a projectile being fired from said barrel before said projectile reaches said at least one container to prevent bursting of the container by other than contacting said projectile.

2. The combination of a pressure damper and a recoilless weapon having a barrel and a muzzle, the pressure damper designed to reduce the pressure in the area around and immediately to the rear of the muzzle of the barrel and comprising at least one container filled with a liquid which is so located in the muzzle region of the barrel that, when the recoilless weapon is fired, the at least one container bursts and as a result explosively releases the said liquid, so that said liquid is mixed with powder gases to reduce the pressure of the powder gases, said barrel is of uniform diameter except for a forward extension section of the barrel which defines an enlargement that terminates at the muzzle, the muzzle having a diameter greater than the diameter of the barrel, the portion of the barrel extending from the uniform diameter portion being of conical shape tapered outwardly, the portion of the barrel extending from the muzzle being of conical shape and tapered outwardly, the two conical shaped portions being interconnected by a portion of cylindrical shape, said at least one container being in the form of a flattened toroid having a complementary shape to the cylindrical portion of the enlargement to fit snugly therein and having an opening diameter greater than the uniform diameter of the barrel.

* * * * *